US011655584B2

(12) United States Patent
Reeves et al.

(10) Patent No.: US 11,655,584 B2
(45) Date of Patent: May 23, 2023

(54) DRYER APPLIANCE NUISANCE TRIP DETECTION

(71) Applicant: Haier US Appliance Solutions, Inc., Wilmington, DE (US)

(72) Inventors: Joshua Reeves, Louisville, KY (US); Ionelia Silvia Prajescu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 257 days.

(21) Appl. No.: 17/060,553

(22) Filed: Oct. 1, 2020

(65) Prior Publication Data

US 2022/0106731 A1 Apr. 7, 2022

(51) Int. Cl.

| | |
|---|---|
| ***D06F 58/50*** | (2020.01) |
| *D06F 103/38* | (2020.01) |
| *D06F 103/32* | (2020.01) |

(52) U.S. Cl.

CPC ..... *D06F 58/50* (2020.02); *D06F 2103/32* (2020.02); *D06F 2103/38* (2020.02)

(58) Field of Classification Search

CPC .. D06F 58/50; D06F 2103/32; D06F 2103/38; D06F 2105/28

USPC ..... 34/89; 219/507

See application file for complete search history.

(56) References Cited

U.S. PATENT DOCUMENTS

| | | | | |
|---|---|---|---|---|
| 6,158,148 | A | 12/2000 | Krausch | |
| 6,725,570 | B2 | 4/2004 | Confoey | |
| 7,444,762 | B2 | 11/2008 | Carow | |
| 2004/0226187 | A1 | 11/2004 | Bruntz | |
| 2014/0257588 | A1 | 9/2014 | Matesa, Jr. | |
| 2014/0350728 | A1 * | 11/2014 | Ashrafzadeh | D06F 58/46 700/275 |

FOREIGN PATENT DOCUMENTS

| | | | | |
|---|---|---|---|---|
| DE | 10025205 | C1 | 9/2001 | |
| DE | 102010031268 | A1 | 1/2012 | |
| EP | 0436374 | B1 | 8/1996 | |
| EP | 2072659 | B1 | 1/2017 | |
| GB | 2220471 | A | 1/1990 | |
| KR | 20050042531 | A * | 11/2003 | D06F 58/28 |

* cited by examiner

*Primary Examiner* — John P McCormack

(74) *Attorney, Agent, or Firm* — Dority & Manning, P.A.

(57) ABSTRACT

Dryer appliances and related methods are disclosed. Such methods may include, or such appliances may be configured for, monitoring a temperature with a thermistor of a primary heat control system of the dryer appliance. The present disclosure also includes determining a relay signal is calling to close a relay and thereby activate a heating system of the dryer appliance and verifying that the relay is closed. The present disclosure further includes allowing a minimum relay on time to elapse after verifying that the relay is closed. The present disclosure also includes determining a temperature gradient of the monitored temperature based on a change in the monitored temperature over the minimum relay on time. The present disclosure further includes detecting a nuisance trip because the determined temperature gradient is negative.

10 Claims, 4 Drawing Sheets

DRYER APPLIANCE NUISANCE TRIP DETECTION

FIELD OF THE INVENTION

The present subject matter relates generally to dryer appliances, and more particularly to dryer appliances configured for detecting when a heating system of the dryer appliance is not operating, such as due to a nuisance trip or heater failure, and related methods.

BACKGROUND OF THE INVENTION

A conventional appliance for drying articles such as a clothes dryer (or laundry dryer) for drying clothing articles typically includes a cabinet having a rotating drum for tumbling clothes and laundry articles therein. One or more heating elements, for example electric heating elements, heat air prior to the air entering the drum, and the warm air is circulated through the drum as the clothes are tumbled to remove moisture from laundry articles in the drum.

In order to avoid excessive heating of articles within the drum, dryer appliances include one or more heat control systems which measure or monitor temperatures within the dryer appliance and deactivate the one or more heating elements in response to the temperatures exceeding predetermined thresholds. For example, the one or more heat control systems may include one or more thermostats which trip, or open a circuit to interrupt a supply of electrical power, at one or more respective temperature thresholds.

When one or more such thermostats trip, it or they must reset before the dryer appliance can resume operation. The time for the reset increases the overall time duration of the drying operation. Thus, it is desirable to minimize or avoid tripping the thermostats. In particular, it is desirable to minimize or avoid tripping of the thermostats due to a false positive or other nuisance tripping of the thermostats.

Accordingly, a dryer appliance having improved heat control systems and improved methods of determining status of the heating systems would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance includes a cabinet with a drum rotatably mounted within the cabinet. The drum defines a chamber for the receipt of articles for drying. The dryer appliance also includes a heating system fluidly coupled to the drum whereby heated air flows from the heating system to the chamber of the drum for drying of articles within the chamber. The dryer appliance further includes a primary heat control system comprising a thermistor and a secondary heat control system comprising a thermostat. The dryer appliance also includes a controller in operative communication with the thermistor of the primary heat control system. The controller is configured to monitor a temperature with the thermistor of the primary heat control system. The controller is also configured to determine a temperature gradient of the monitored temperature based on a rate of change in the monitored temperature over time. When the temperature gradient changes from positive to negative, the controller is configured to store a current value of the monitored temperature as a peak temperature. After a first wait period has elapsed, the controller is further configured to verify the temperature gradient is still negative. After verifying the temperature gradient is still negative after the first wait period, the controller is configured to verify there is a call for heating. The controller is also configured to allow a second wait period to elapse after verifying the call for heating. After the second wait period, the controller is configured to verify the temperature gradient is still negative. After verifying the temperature gradient is still negative after the second wait period, the controller is configured to store a present value of the monitored temperature. The controller is further configured to determine that a difference between the peak value of the monitored temperature and the present value of the monitored temperature is greater than a predetermined threshold. The controller is also configured to detect a nuisance trip because the difference between the peak value of the monitored temperature and the present value of the monitored temperature is greater than the predetermined threshold.

In another exemplary aspect of the present disclosure, a method of operating a dryer appliance is provided. The method includes monitoring a temperature with a thermistor of a primary heat control system of the dryer appliance and determining a temperature gradient of the monitored temperature based on a rate of change in the monitored temperature over time. When the temperature gradient changes from positive to negative, the method includes storing a peak value of the monitored temperature. After a first wait period, the method includes verifying the temperature gradient is still negative. After verifying the temperature gradient is still negative, the method includes verifying there is a call for heating. After verifying the call for heating, the method includes allowing a second wait period to elapse. After the second wait period, the method includes verifying the temperature gradient is still negative. After verifying the temperature gradient is still negative, the method includes storing a present value of the monitored temperature. The method also includes determining that a difference between the peak value of the monitored temperature and the present value of the monitored temperature is greater than a predetermined threshold. The method further includes detecting a nuisance trip because the difference between the peak value of the monitored temperature and the present value of the monitored temperature is greater than the predetermined threshold.

In yet another exemplary aspect of the present disclosure, a method of operating a dryer appliance is provided. The method includes monitoring a temperature with a thermistor of a primary heat control system of the dryer appliance. The method also includes determining a relay signal is calling to close a relay and thereby activate a heating system of the dryer appliance and verifying that the relay is closed. The method further includes allowing a minimum relay on time to elapse after verifying that the relay is closed. The method also includes determining a temperature gradient of the monitored temperature based on a change in the monitored temperature over the minimum relay on time. The method further includes detecting a nuisance trip because the determined temperature gradient is negative.

These and other features, aspects, and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
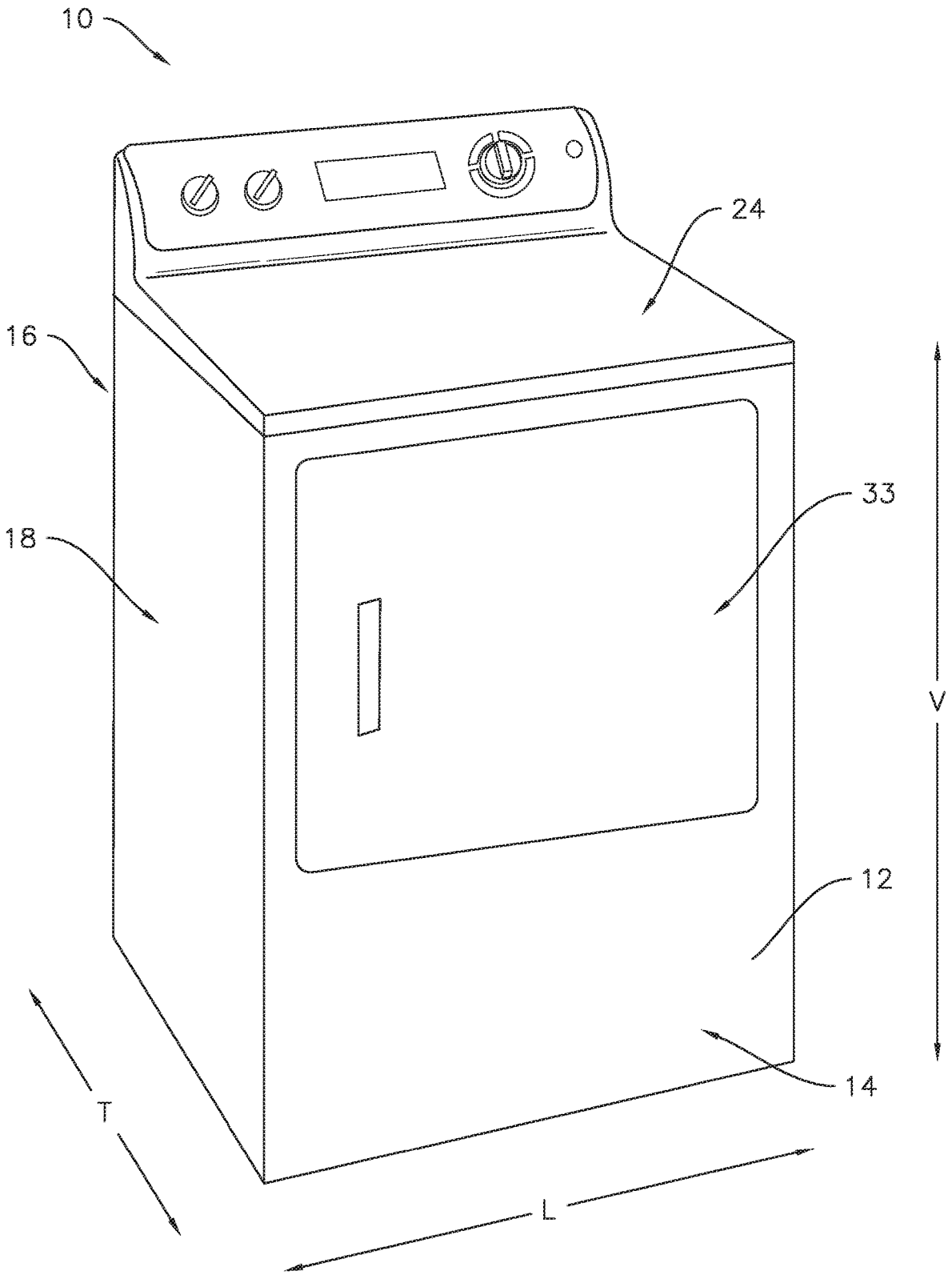
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
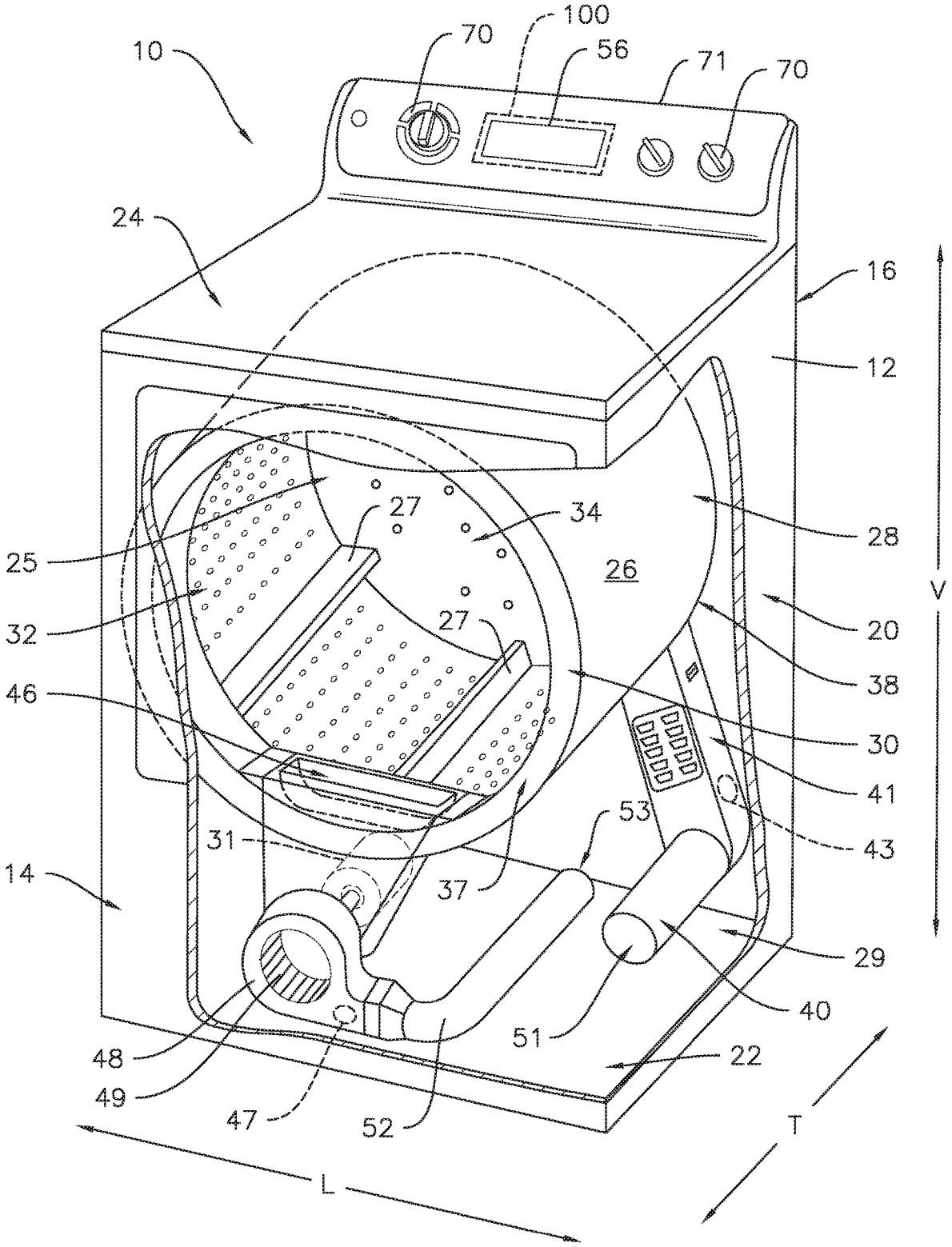
FIG. 2 provides a perspective view of the example dryer appliance of FIG. 1 with portions of a cabinet of the dryer appliance removed to reveal certain components of the dryer appliance.

Turning now to the figures, FIG. 1 provides a perspective view of dryer appliance 10 according to one or more exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heating assembly or system 40, as will be described further below. Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., via holes in the rear wall 34 as mentioned above, in order to dry damp articles disposed within chamber 25 of drum 26. For example, heating assembly 40 may include a heating element (not shown), such as a gas burner, an electrical resistance heating element, or heat pump, for heating air. In particular embodiments, the heating assembly 40 may be or include an electric heater comprising a plurality of electric resistance heating elements with a plurality of relays for selectively providing or obstructing electrical power to the heating elements, such as two relays which permit operation of the heating assembly 40 at various power levels, such as 50% power when only one of two relays is closed. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture-saturated air through a screen filter (not shown) which traps lint particles. Such moisture-statured air then enters an exit duct 46 and is passed through air handler 48 to an exhaust duct 52. From exhaust duct 52, such moisture-statured air passes out of dryer appliance 10 through a vent 53 defined by cabinet 12. After the clothing articles have been dried, they are removed from the drum 26 via opening 32. A door 33 (FIG. 1) provides for closing or accessing drum 26 through opening 32. The door 33 may be movable between an open position and a closed position, the open position for access to the chamber 25 defined in the drum 26, and the closed position for sealingly enclosing the chamber 25 defined in the drum 26.

In some embodiments, one or more selector inputs 70, such as knobs, buttons, touchscreen interfaces, etc., may be provided or mounted on a cabinet 12 (e.g., on a backsplash 71 of the cabinet 12) and are in operable communication (e.g., electrically coupled or coupled through a wireless network band) with a processing device or controller 100. A display 56 may also be provided on the backsplash 71 and may also be in operable communication with the controller 100. Controller 100 may also be provided in operable communication with motor 31, air handler 48, and/or heating assembly 40. In turn, signals generated in controller 100 direct operation of motor 31, air handler 48, and/or heating assembly 40 in response to the position of inputs 70. In the example illustrated in FIG. 2, the inputs 70 are provided as knobs. In other embodiments, inputs 70 may also or instead include buttons, switches, touchpads and/or a touch screen type interface.

Controller 100 is a "processing device" or "controller" and may be embodied as described herein. As used herein, "processing device" or "controller" may refer to one or more microprocessors, microcontrollers, application-specific integrated circuits (ASICS), or semiconductor devices and is not restricted necessarily to a single element. The controller 100 may be programmed to operate dryer appliance 10 by executing instructions stored in memory (e.g., non-transitory media). The controller 100 may include, or be associated with, one or more memory elements such as RAM, ROM, or electrically erasable, programmable read only memory (EEPROM). For example, the instructions may be software or any set of instructions that when executed by the processing device, cause the processing device to perform operations. Controller 100 may include one or more processor(s) and associated memory device(s) configured to perform a variety of computer-implemented functions and/or instructions (e.g. performing the methods, steps, calculations and the like and storing relevant data as disclosed herein). It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In some exemplary embodiments, the dryer appliance 10 may include one or more temperature sensors, such as inlet temperature sensor 43 and/or outlet temperature sensor 47. The temperature sensor(s) may be in operative communication with the controller 100. For example, in various embodiments, the controller 100 may be operable to detect, measure, and/or monitor one or more temperatures within the dryer appliance 10. Such temperatures which may be detected, measured, and/or monitored include, for example, an inlet temperature measured with the inlet temperature sensor 43 and/or an outlet temperature measured with the outlet temperature sensor 47. The temperature sensors 43 and 47 may be, in some embodiments, thermistors.

The temperature sensors 43 and 47 may be part of a primary heat control system of the dryer appliance 10. The dryer appliance 10 may also include a secondary or backup heat control system including one or more thermostats. When either the primary heat control system or the second heat control system (or both) detects excessive heat, e.g., a temperature above a threshold or limit value, which may be an instantaneous temperature or a temperature exceeding the limit for a minimum period of time, the heating assembly 40 may be deactivated until the respective heat control system resets. As will be recognized by those of ordinary skill in the dryer art, the thermostats of the secondary heat control system generally take longer to reset after detecting excessive heat. Thus, the secondary heat control system may be set to a higher temperature threshold value or temperature limit in order to reduce or avoid tripping the secondary heat control system and thus reduce or avoid the relatively longer (as compared to the thermistors of the primary heat control system) reset time of the thermostat(s) in the secondary heat control system.

In some instances, the secondary heat control system may experience a nuisance trip, when one or more, e.g., both, thermostats in the secondary heat control system trip and deactivate, e.g., cut off electric power from, the heating assembly 40.

Figure 3:
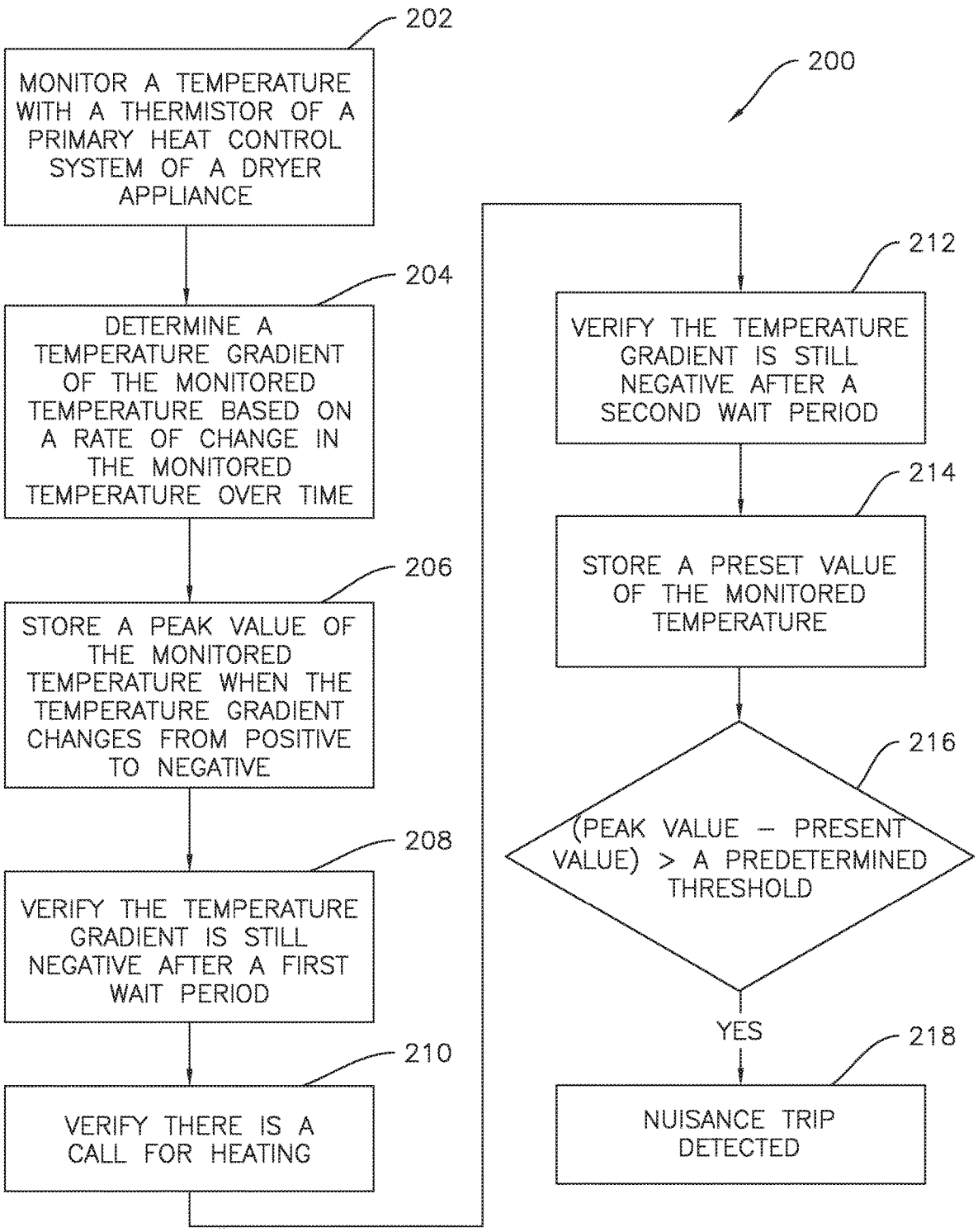
FIG. 3 provides a flow chart of an exemplary method of operating a dryer appliance according to one or more embodiments of the present disclosure.

FIG. 3 provides a flow chart of an exemplary method 200 of operating a dryer appliance according to one or more additional embodiments of the present disclosure. Method 200 may begin with an initial step 202 of monitoring a temperature with a thermistor of a primary heat control system of the dryer appliance. For example, the thermistor may be an inlet thermistor and the temperature may be a temperature within the inlet duct of the dryer appliance. As another example, the thermistor may be an outlet thermistor and the temperature may be a temperature within the outlet duct of the dryer appliance. Monitoring the temperature may include continuously measuring or detecting the temperature or measuring the temperature repeatedly at predetermined intervals, such as every second or twice per second, etc.

As shown at 204 in FIG. 3, the method 200 may also include determining a temperature gradient of the monitored temperature based on a rate of change in the monitored temperature over time. For example, the temperature gradient may be a slope of the temperature over time. A positive temperature gradient may correspond to increasing temperature, whereas a negative temperature gradient may correspond to decreasing temperature. When the temperature gradient changes from positive to negative, e.g., when the slope of the temperature over time inflects because the temperature stops increasing and starts to decrease, the method 200 may include a step 206 of storing the current value of the temperature as a peak value of the temperature.

After storing the peak value of the temperature, the method 200 may then allow a first wait period to elapse. For example, as illustrated at step 208 in FIG. 3, the method 200 may include verifying that the temperature is still decreasing, e.g., verifying the temperature gradient is still negative, after the first wait period. In various embodiments, the first wait period may be between about one second and about ten seconds, such as between about two seconds and about seven seconds, such as about three seconds.

When the temperature has continued to decrease after the first wait period, the method 200 may also include verifying that there is a call for heating, e.g., as illustrated at step 210 in FIG. 3. Verifying the call for heating indicates that the negative temperature gradient, e.g., the decreasing temperature, was not caused by the primary heat control system or the controller turning off the heat. Verifying the call for heating may include verifying that at least one relay of the heating system is closed, such that electrical power is supplied to at least one heating element of the heating system but for the primary heat control system and/or secondary heat control system having tripped, in particular, verifying that there is a call for heating while the temperature is nonetheless continuing to decrease may confirm that the thermostat of the secondary heat control has tripped and is preventing activation of the heating element despite the closed relay.

In some embodiments, the method 200, e.g., the step 210 of verifying the call for heating, may also include verifying that no relays were opened within a predetermined period of time, such as within the last about fifteen seconds. The predetermined period of time may, in various embodiments, be between about five seconds and about thirty-five seconds, such as between about ten seconds and about thirty seconds, such as between about fifteen seconds and about twenty-five seconds, such as about fifteen seconds, or about twenty seconds, or about twenty-five seconds.

When the temperature gradient is still negative at step 208 and there is a call for heating, e.g., no relays were opened within the predetermined period of time and/or at least one relay is closed, at step 210, the method 200 may then include a second wait period. In various embodiments, the second wait period may be between about five seconds and about twenty-five seconds, such as between about ten seconds and about twenty seconds, such as about fifteen seconds.

In some embodiments, for example as illustrated at step 212 in FIG. 3, the method 200 may further include verifying that the temperature gradient is still negative after the second wait period. As illustrated in FIG. 3, the step 212 occurs after, and in at least some embodiments is performed because, the temperature gradient was negative after the first wait period, e.g., at step 208, and the call for heating was verified, e.g., at step 210.

In some embodiments, the monitored temperature may be an inlet temperature which is monitored with an inlet thermistor, e.g., a thermistor which is positioned upstream of the drum 26 and the chamber 25 defined therein with respect to the flow of heated air from the heating system 40. For example, the inlet thermistor may be inlet temperature sensor 43 positioned in the supply duct 41, e.g., as illustrated in FIG. 2. In embodiments where the monitored temperature is the inlet temperature, the method may also include measuring an outlet temperature and comparing the outlet temperature to one or more outlet temperature setpoints. For example, the outlet temperature may be a temperature value measured and/or monitored with a thermistor downstream of the drum 26 and the chamber 25 defined therein with respect to the flow of heated air from the heating system 40, such as the outlet temperature sensor 47 positioned in the exhaust duct 52 and/or downstream of the air handler 48, e.g., as illustrated in FIG. 2. Comparing the outlet temperature to one or more outlet temperature setpoints may be or include determining whether the outlet temperature is less than at least one minimum outlet upper setpoint. For example, in embodiments where more than one relay is included, the primary heat control system may include an upper and lower setpoint for each thermistor and each relay, e.g., four total setpoints in embodiments which include two thermistors (such as the inlet thermistor and the outlet thermistor) and two relays, such as the inlet thermistor may have a lower setpoint at which one relay is opened and an upper setpoint at which both relays are opened, while the outlet thermistor also has a lower setpoint at which one relay is opened and an upper setpoint at which both relays are opened. In particular embodiments, the setpoints may include a lower inlet setpoint and an upper inlet setpoint based on the inlet temperature measured or monitored with the inlet thermistor and a lower outlet setpoint and an upper outlet setpoint based on the outlet temperature measured or monitored with the outlet thermistor. The lower inlet setpoint and the lower outlet setpoint may control a first relay while the upper inlet setpoint and the upper outlet setpoint control a second relay. Thus, in some exemplary embodiments, the method 200 may include comparing the outlet temperature to both the upper outlet setpoint and the lower outlet setpoint, such as determining whether the outlet temperature is less than both the upper outlet setpoint and the lower outlet setpoint. This comparison may be useful to determine or verify that the operation of the heating system is inlet-controlled, e.g., that the heating system is activated (including partially activated, such as when only one of multiple relays is closed) or deactivated (i.e., when the heating system is not drawing power, although other components of the dryer appliance, such as the motor, may be drawing power) based on the inlet temperature rather than on the outlet temperature.

In some embodiments, the method 200 may include allowing a third wait period to elapse. In various embodiments, the third wait period may be between about five seconds and about twenty-five seconds, such as between about ten seconds and about twenty seconds, such as about fifteen seconds. Allowing the third wait period to elapse may be performed after verifying that the temperature gradient is still negative following the second wait period and/or after comparing the outlet temperature to the one or more outlet temperature setpoints (e.g., determining whether the outlet temperature is less than both the upper outlet setpoint and the lower outlet setpoint, as described above). In embodiments which include the third wait period, the method 200 may also include a third slope check, e.g., verifying that the temperature gradient is still negative after the third wait period.

As illustrated at step 214 in FIG. 3, in some embodiments, the method 200 may include storing a present value of the monitored temperature, e.g., in a memory of the controller, after verifying that the temperature gradient is still negative. In various example embodiments, the present value may be stored after verifying that the temperature gradient is still negative following the second wait period and/or after verifying that the temperature gradient is still negative following the third wait period.

Still with reference to FIG. 3, in some embodiments, the method 200 may include a step 216 of comparing a difference between the stored present value and the stored peak value with a predetermined threshold. For example, the difference between the present value and the peak value may be a mathematical difference determined by subtracting the present value from the peak value. Comparing the difference between the stored present value and the stored peak value with the predetermined threshold may include determining whether the difference between the stored present value and the stored peak value is greater than the predetermined threshold.

In at least some embodiments, e.g., as illustrated at step 218 in FIG. 3, the method 200 may then include determining or detecting a nuisance trip because the difference between the peak value of the monitored temperature and the present value of the monitored temperature is greater than the predetermined threshold.

In at least some embodiments, after detecting the nuisance trip, the primary heat control system temperature setpoints may be lowered in order to reduce the chance of another nuisance trip. For example, with lower primary heat control system setpoints, it is more likely that the heating system will be controlled by or in response to the primary heat control system before reaching a temperature at which the thermostat(s) of the secondary heat control system will trip. In some embodiments, a count may be increased, e.g., by one, after detecting the nuisance trip. In such embodiments, lowering the setpoints of the primary heat control system may be performed after the count reaches a limit value.

Figure 4:
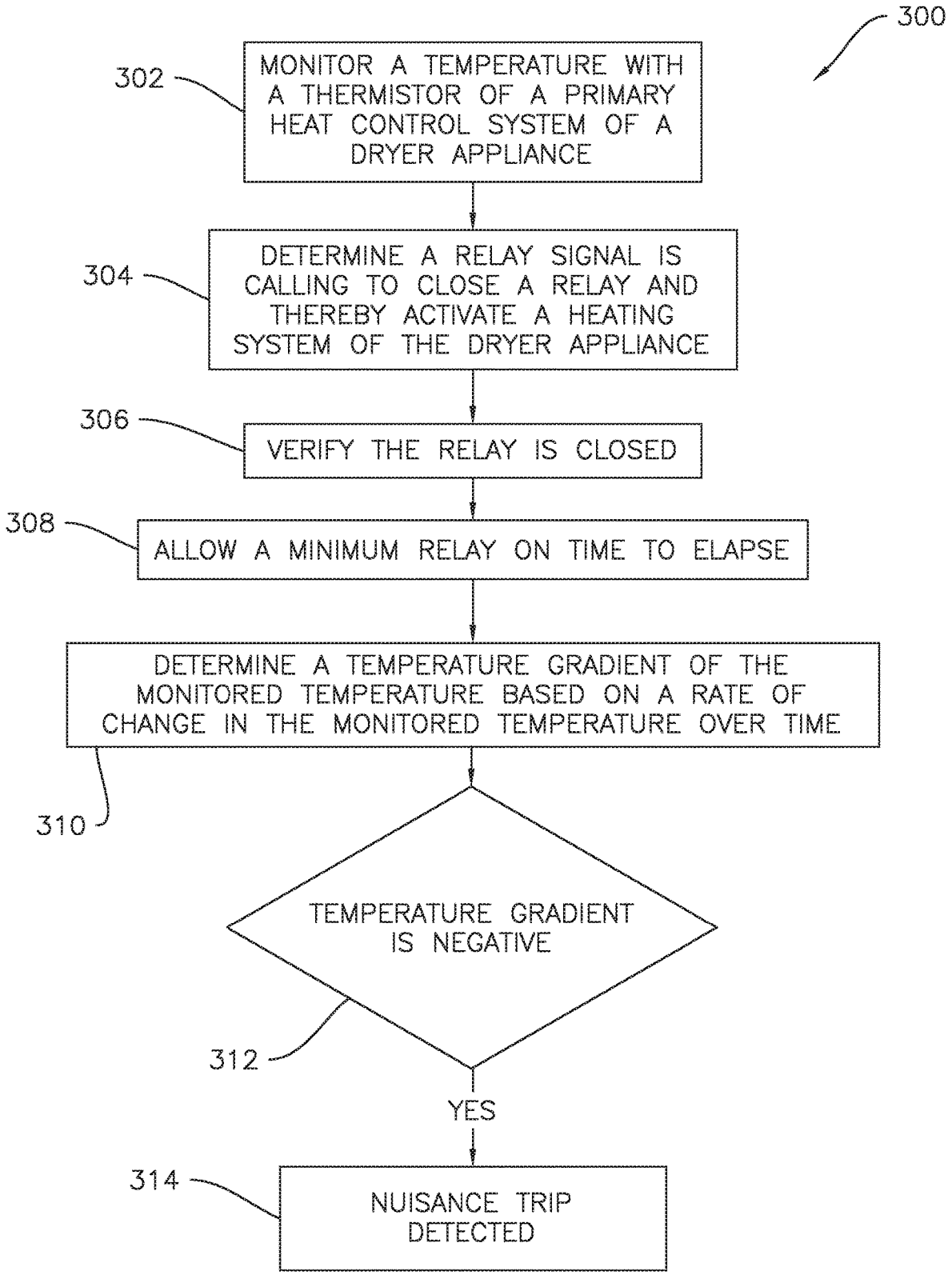
FIG. 4 provides a flow chart of another exemplary method of operating a dryer appliance according to one or more embodiments of the present disclosure.

Turning now to FIG. 4, embodiments of the present disclosure may also include the method 300 of detecting a nuisance trip of the secondary heat control system, e.g., one or more thermostats thereof, in a dryer appliance. Method 300 generally comprises looking for the monitored temperature, e.g., the inlet temperature, to increase after the heating system has been on for a minimum time. More specifically, as illustrated at step 302 in FIG. 4, method 300 may include monitoring a temperature within the dryer appliance, such as an inlet temperature within a supply duct thereof or otherwise upstream of a chamber thereof, with a thermistor of a primary heat control system of the dryer appliance.

The method 300 may then include determining that at least one relay configured for providing electrical power to the heating system is on. For example, as illustrated at step 304 in FIG. 4, the method 300 may include checking the relay signal, e.g., determining a relay signal is calling to close a relay and thereby activate a heating system of the dryer appliance. Also as illustrated in the exemplary embodiment of FIG. 4, the method 300 may include a step 306 of verifying that the relay turned on, e.g., that the relay is closed, when there is a signal to the relay calling for such.

After verifying that the relay is closed, the method 300 may include a step 308 of allowing a minimum on time to elapse. In various embodiments, the minimum on time may be between about five seconds and about ten seconds, such as about seven and a half seconds.

In some embodiments, e.g., as illustrated at step 310 in FIG. 4, the method 300 may also include determining a temperature gradient of the monitored temperature based on a rate of change in the monitored temperature over time. For example, the temperature gradient may be a slope of the temperature over time. A positive temperature gradient may correspond to increasing temperature, whereas a negative temperature gradient may correspond to decreasing temperature.

The method 300 may then include determining whether the temperature gradient is negative, e.g., as illustrated at step 312 in FIG. 4. When the temperature gradient is negative after the minimum relay on time has elapsed, a nuisance trip may be detected. For example, the method 300 may include a step 314 of detecting a nuisance trip because the determined temperature gradient is negative after the minimum relay on time.

Embodiments of the present disclosure include dryer appliances and related methods with indirect detection of the status of the thermostat(s) in the secondary heat control system. For example, the dryer appliances and methods disclosed herein may detect a nuisance trip of the thermostat without a direct physical connection to the thermostat. As another example, the dryer appliances and methods disclosed herein may also be useful for detecting a malfunction or fault in the heating system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a chamber for the receipt of articles for drying;

a heating system fluidly coupled to the drum whereby heated air flows from the heating system to the chamber of the drum for drying of articles within the chamber;

a primary heat control system comprising a thermistor;

a secondary heat control system comprising a thermostat; and a controller in operative communication with the thermistor of the primary heat control system, the controller configured to:

monitor a temperature with the thermistor of the primary heat control system;

determine a temperature gradient of the monitored temperature based on a rate of change in the monitored temperature over time;

store a current value of the monitored temperature as a peak temperature when the temperature gradient changes from positive to negative;

verify the temperature gradient is still negative after a first wait period;

verify there is a call for heating after verifying the temperature gradient is still negative after the first wait period;

allow a second wait period to elapse after verifying the call for heating;

verify the temperature gradient is still negative after the second wait period;

store a present value of the monitored temperature after verifying the temperature gradient is still negative after the second wait period;

determine that a difference between the peak value of the monitored temperature and the present value of the monitored temperature is greater than a predetermined threshold; and detect a nuisance trip because the difference between the peak value of the monitored temperature and the present value of the monitored temperature is greater than the predetermined threshold.

2. The dryer appliance of claim 1, further comprising a relay coupled to the heating system whereby the heating system is energized when the relay is closed, and wherein the controller is configured to verify the call for heating after verifying the temperature gradient is still negative after the first wait period by verifying that the relay is closed.

3. The dryer appliance of claim 1, further comprising a relay coupled to the heating system whereby the heating system is energized when the relay is closed, and wherein the controller is configured to verify the call for heating after verifying the temperature gradient is still negative after the first wait period by verifying that the relay has not opened within a predetermined time period.

4. The dryer appliance of claim 1, wherein the heating system is fluidly coupled to the drum by an inlet duct whereby heated air flows from the heating system via the inlet duct to the chamber of the drum, further comprising an outlet duct fluidly coupled to the drum downstream of the chamber, and wherein the thermistor of the primary heat control system with which the temperature is monitored is an inlet thermistor in the inlet duct of the dryer appliance.

5. The dryer appliance of claim 4, wherein the primary heat control system further comprises an outlet thermistor positioned in the outlet duct of the dryer appliance.

6. A method of operating a dryer appliance, the method comprising:

monitoring a temperature with a thermistor of a primary heat control system of the dryer appliance;

determining a temperature gradient of the monitored temperature based on a rate of change in the monitored temperature over time;

storing a peak value of the monitored temperature when the temperature gradient changes from positive to negative;

verifying the temperature gradient is still negative after a first wait period;

verifying there is a call for heating after verifying the temperature gradient is still negative after the first wait period;

allowing a second wait period to elapse after verifying the call for heating;

verifying the temperature gradient is still negative after the second wait period;

storing a present value of the monitored temperature after verifying the temperature gradient is still negative after the second wait period;

determining that a difference between the peak value of the monitored temperature and the present value of the monitored temperature is greater than a predetermined threshold; and detecting a nuisance trip because the difference between the peak value of the monitored temperature and the present value of the monitored temperature is greater than the predetermined threshold.

7. The method of claim 6, wherein verifying the call for heating after verifying the temperature gradient is still negative after the first wait period comprises verifying that at least one relay is closed such that a heating system of the dryer appliance is active.

8. The method of claim 6, wherein verifying the call for heating after verifying the temperature gradient is still negative after the first wait period comprises verifying that no relays in a heating system of the dryer appliance opened within a predetermined time period.

9. The method of claim 6, wherein the thermistor of the primary heat control system is an inlet thermistor positioned in an inlet duct of the dryer appliance.

10. The method of claim 9, wherein the primary heat control system further comprises an outlet thermistor positioned in an outlet duct of the dryer appliance.

* * * * *